US009879849B2

(12) United States Patent
Kinnune et al.

(10) Patent No.: US 9,879,849 B2
(45) **Date of Patent: *Jan. 30, 2018**

(54) LED LIGHT FIXTURE HAVING HEAT SINK WITH FINS AT FLOW-THROUGH OPENING

(71) Applicant: Cree, Inc., Durham, NC (US)

(72) Inventors: Brian Kinnune, Racine, WI (US); David P. Goelz, Milwaukee, WI (US); Kurt S. Wilcox, Libertyville, IL (US); Craig Raleigh, Racine, WI (US)

(73) Assignee: Cree, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/677,478

(22) Filed: Apr. 2, 2015

(65) Prior Publication Data

US 2015/0323168 A1 Nov. 12, 2015

Related U.S. Application Data

(63) Continuation of application No. 13/441,567, filed on Apr. 6, 2012, now Pat. No. 9,121,582.

(51) Int. Cl.
*F21V 29/00* (2015.01)
*F21S 8/08* (2006.01)
(Continued)

(52) U.S. Cl.
CPC ..... *F21V 29/76* (2015.01); *F21V 5/007* (2013.01); *F21V 5/048* (2013.01);
(Continued)

(58) Field of Classification Search
CPC .... F21S 6/005; F21S 6/006; F21S 8/08; F21S 8/085; F21S 8/086; F21S 8/088; F21V 29/002; F21V 29/004; F21V 29/2212; F21V 29/503; F21V 29/74; F21V 29/76; F21V 29/767; F21W 2111/02; F21Y 2105/001
See application file for complete search history.

(56) References Cited

U.S. PATENT DOCUMENTS 7,236,366 B2 * 6/2007 Chen ..... F21K 9/00 257/712
7,566,147 B2 * 7/2009 Wilcox ..... F21V 15/01 362/240

(Continued)

FOREIGN PATENT DOCUMENTS

EP 1895232 B1 5/2010
WO 2011/076219 6/2011

OTHER PUBLICATIONS

Philips. Roadstar Luminaire brochure.
Leotek. LED Street Lighting, Green Cobra brochure.

*Primary Examiner* — Ismael Negron
(74) *Attorney, Agent, or Firm* — Jansson Munger McKinley & Kirby Ltd.

(57) ABSTRACT

An LED light fixture including a heat-conductive overstructure having upper and lower surfaces and a plurality of upwardly-protruding elongate fins which extend along the upper surface adjacent to at least one opening through the fixture permitting air flow from beneath the lower surface to above the upper surface. An LED light source is secured with respect to the lower surface. The fins have heights which gradually increase toward fin-ends proximal to the at least one opening.

18 Claims, 10 Drawing Sheets

(51) Int. Cl.

| | |
|---|---|
| ***F21V 29/76*** | (2015.01) |
| ***F21V 23/00*** | (2015.01) |
| ***F21V 5/04*** | (2006.01) |
| ***F21V 5/00*** | (2015.01) |
| ***F21V 19/00*** | (2006.01) |
| ***F21V 29/83*** | (2015.01) |
| *F21W 131/103* | (2006.01) |
| *F21W 131/40* | (2006.01) |

(52) U.S. Cl.
CPC ..... *F21V 19/0055* (2013.01); *F21V 23/009* (2013.01); *F21V 29/004* (2013.01); *F21V 29/2212* (2013.01); *F21V 29/83* (2015.01); *F21W 2131/103* (2013.01); *F21W 2131/40* (2013.01)

(56) References Cited

U.S. PATENT DOCUMENTS

| | | | | |
|---|---|---|---|---|
| 8,092,049 | B2 | 1/2012 | Kinnune et al. | |
| 8,360,613 | B2 * | 1/2013 | Little, Jr. | F21V 15/01 362/218 |
| 8,419,217 | B2 * | 4/2013 | Lu | F21V 29/004 362/249.02 |
| 8,659,901 | B2 | 2/2014 | MacManus et al. | 361/709 |
| 8,764,244 | B2 * | 7/2014 | Jeon | F21S 2/005 362/218 |
| 8,845,116 | B2 * | 9/2014 | Kim | F21K 9/00 362/235 |
| 9,028,096 | B2 * | 5/2015 | Verdes | F21V 29/004 362/238 |
| 9,121,582 | B2 * | 9/2015 | Kinnune | F21V 29/004 |
| 9,243,794 | B2 * | 1/2016 | Wilcox | F21V 29/004 |
| 2002/0109970 | A1 | 8/2002 | Yang | |
| 2005/0276053 | A1 | 12/2005 | Nortrup et al. | |
| 2006/0042291 | A1 | 3/2006 | Petroski | |
| 2007/0070628 | A1 | 3/2007 | Chen | 362/249 |
| 2007/0089869 | A1 | 4/2007 | Hwang et al. | 165/152 |
| 2008/0080196 | A1 | 4/2008 | Ruud et al. | 362/373 |
| 2008/0298062 | A1 | 12/2008 | Wang | 362/247 |
| 2009/0021933 | A1 | 1/2009 | Mayer et al. | 362/240 |
| 2009/0251898 | A1 | 10/2009 | Kinnune | |
| 2009/0323361 | A1 | 12/2009 | Liu | |
| 2010/0014289 | A1 * | 1/2010 | Thomas | F21V 15/01 362/235 |
| 2010/0061092 | A1 * | 3/2010 | Yang | F21V 15/01 362/234 |
| 2010/0214775 | A1 | 8/2010 | Liang | 362/184 |
| 2011/0013402 | A1 | 1/2011 | Little, Jr. | |
| 2011/0018418 | A1 | 1/2011 | Yoo | |
| 2011/0188233 | A1 | 8/2011 | Josefowicz et al. | |
| 2011/0235343 | A1 | 9/2011 | Arai | 362/373 |
| 2012/0327641 | A1 * | 12/2012 | Holder | F21V 29/70 362/184 |
| 2013/0083522 | A1 * | 4/2013 | Bowers | F21V 29/004 362/235 |
| 2013/0088864 | A1 | 4/2013 | Verdes et al. | 362/235 |
| 2013/0250556 | A1 | 9/2013 | Gordin et al. | 362/147 |
| 2014/0049961 | A1 | 2/2014 | Wilcox et al. | 362/244 |

* cited by examiner

FIG. 14
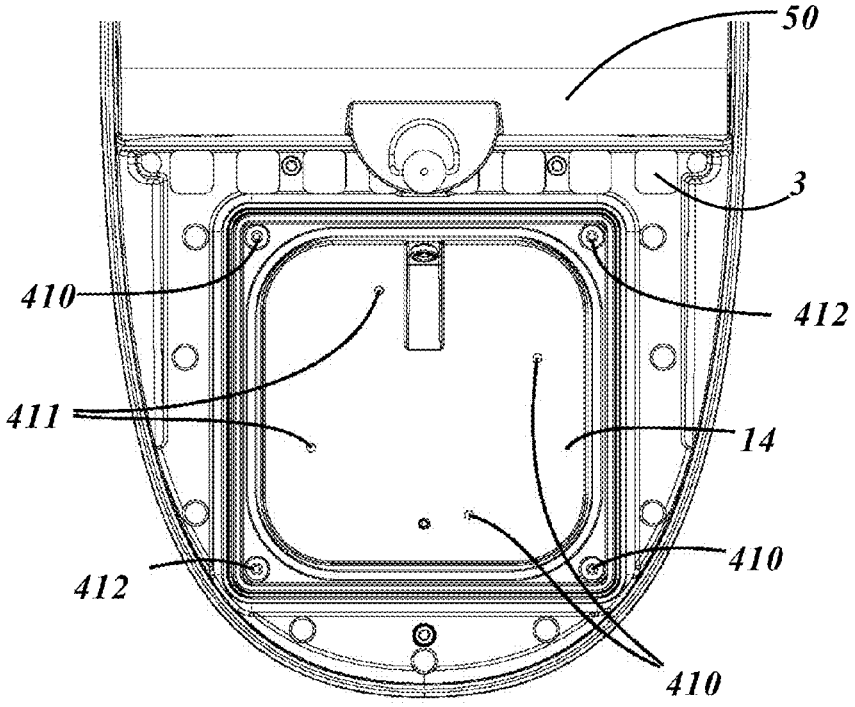
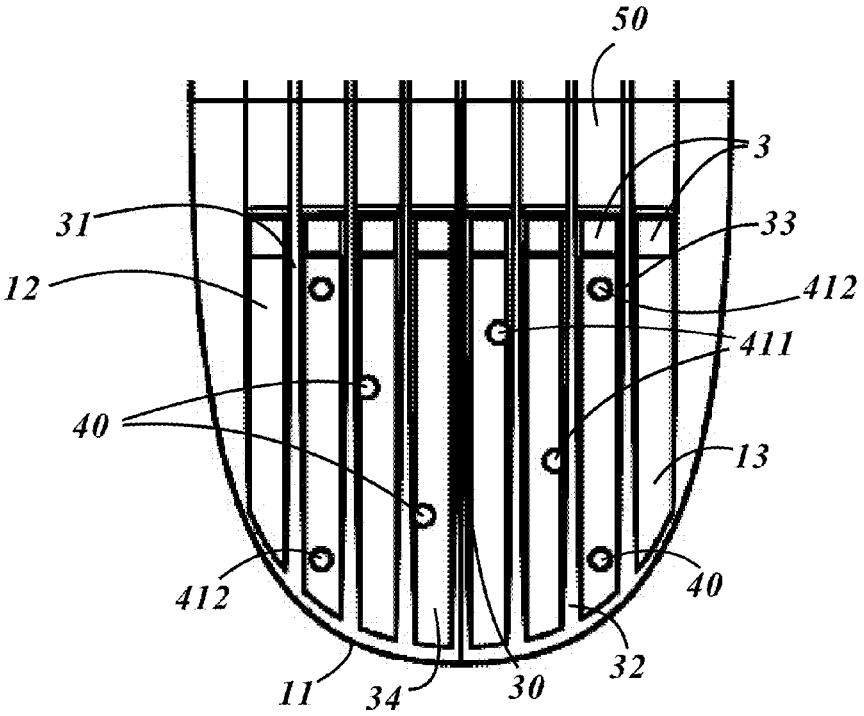
FIG. 15

LED LIGHT FIXTURE HAVING HEAT SINK WITH FINS AT FLOW-THROUGH OPENING

RELATED APPLICATION

This application is a continuation of patent application Ser. No. 13/441,567, filed Apr. 6, 2012, the entirety of the contents of which are incorporated herein by reference.

FIELD OF THE INVENTION

This invention relates generally to the field of LED light fixtures and, more particularly, to the field of LED light fixtures for various high-luminance area lighting applications such as roadway lighting, factory lighting, parking lot lighting, commercial building lighting, and the like.

BACKGROUND OF THE INVENTION

In recent years, the use of light-emitting diodes (LEDs) in development of lighting fixtures for various common lighting purposes has increased, and this trend has accelerated as advances have been made in the field. Indeed, lighting applications which previously had typically been served by fixtures using what are known as high-intensity discharge (HID) lamps are now being served by LED light fixtures. Such lighting applications include, among a good many others, roadway lighting, factory lighting, parking lot lighting, and commercial building lighting.

High-luminance light fixtures using LED modules as light source present particularly challenging problems. One particularly challenging problem for high-luminance LED light fixtures relates to heat dissipation. Such fixtures typically have a large number of LEDs, often in plural LED modules, and particular structures have been developed to facilitate heat dissipation. Among the advances in the field are the inventions of U.S. Pat. Nos. 7,686,469, 8,070,306 and 8,092,364. Such products utilize finned structures to facilitate dissipation of heat to the atmosphere.

Improvement in dissipating heat to the atmosphere is one significant objective in the field of LED light fixtures. It is of importance for various reasons, one of which relates to extending the useful life of the lighting products. Achieving improvements without expensive additional structure and apparatus is much desired.

This is because a major consideration in the development of high-luminance LED light fixtures for various high-volume applications, such as roadway lighting, is controlling product cost even while delivering improved light-fixture performance.

In summary, finding ways to significantly improve the dissipation of heat to the atmosphere from LED light fixtures would be much desired, particularly in a fixture that is easy and inexpensive to manufacture.

SUMMARY OF THE INVENTION

The present invention is an improved LED light fixture with improved heat dissipation.

In one embodiment, the inventive light fixture includes elongate fins extending from a heat-conductive structure and defining between-fin channels. In certain embodiments, the fixture defines upward-flow openings extending through the fixture and positioned at locations between the fins. The upward-flow openings may be vertical-flow openings, but the upward-flow openings could be angled with respect to true vertical. In some embodiments the elongate fins of the heat sink have heights which are smallest at the distal fin-ends, i.e., typically the location where the elongate fins reach an edge of the fixture, and gradually increase toward the proximal fin-ends (i.e., the opposite ends of the elongate fins). The fins have distal fin-ends and proximal fin-ends and in certain embodiments the between-fin upward-flow openings are adjacent to the proximal fin-ends; however, the between-fin upward-flow openings could be positioned elsewhere along the fins.

In another embodiment, the light fixture includes: (1) a heat-conductive overstructure having upper and lower surfaces and first and second ends; (2) an LED light source secured with respect to the lower surface; and (3) a heat sink on the upper surface, the heat sink having (a) a plurality of upwardly-protruding elongate fins extending therealong from distal fin-ends adjacent to the first end to proximal fin-ends adjacent to the second end, the fins defining horizontal between-fin channels open at the distal fin-ends, the fixture defining vertical-flow openings adjacent to the proximal fin-ends.

Some embodiments may include a plurality of flow-interrupters adjacent fins changing air flow along the channels. In some of such embodiments the flow-interrupters have heights which are less than the heights of their respective between-fin channels, and may be less than about half the heights of their respective between-fin channels. The channels have channel bottom surfaces and the flow-interrupters may extend upwardly therefrom. The flow-interrupters may be dimensioned to extend across less than the full widths of their respective channels, thereby allowing water flow past them along the bottom surfaces of their respective channels. The flow-interrupters may engage only one of the two fins that form their respective channels.

In certain embodiments, the flow-interrupters are posts (i.e., post-like structures) that extend upwardly from proximal ends at the bottom surfaces of their respective channels to free distal ends somewhat above the bottom surfaces of their respective channels. In such situations, at least some of the flow-interrupter posts serve as connection points (mounting bosses), from beneath the bottom surface, for securement of the LED light source to the lower surface of the heat-conductive overstructure.

In other embodiments, flow-interrupters are wall structures, which may be fairly flat and thin, and are integrally-formed with their respective channel bottoms and at least one of the fins forming their respective channels. The wall structures may be integrally-formed with only one of the fins forming their respective channels to allow water flow past the wall structures along the bottom surfaces of their respective channels.

In alternative embodiments, the overstructure and the heat sink, with all portions thereof (including the fins and the flow-interrupters), are formed as one piece.

The LED light fixture may also include a housing secured with respect to the overstructure. The housing may include a substantially-closed chamber that encloses at least one electronic LED driver. In certain versions of the fixture, the housing is at the second end of the overstructure and the vertical-flow openings are partially defined by the housing with the proximal fin-ends secured with respect to the housing. Housing and the heat sink may be formed as one piece. And, the overstructure, heat sink and the housing may all be formed as one piece. One example of such one piece is a single casting.

In some alternative embodiments, at least some of the flow-interrupters are or include mounting bosses accepting fasteners for securing the LED light source in place against the lower surface of the heat-conductive overstructure.

In some embodiments, the LED light source includes a circuit board with a plurality of LED emitters spaced thereon and a plurality of primary lenses each over a corresponding one of the LED emitters. The circuit board defines holes therethrough in positions for alignment with a first set of the mounting bosses. The mounting bosses have fastener-receiving cavities accessible from their undersides.

And a first set of fasteners extends through the holes in the circuit board and into the mounting bosses (from the underside) to secure the circuit board to the lower surface of the heat-conductive overstructure.

The LED light source may also include a one-piece lensing member placed over the circuit board. In certain embodiments, the lensing member is against the lower surface of the heat-conductive overstructure with the circuit board sandwiched therebetween. The lensing member includes a plurality of secondary lenses each spaced over a corresponding one of the primary lenses, and the lensing member defines holes therethrough in positions for alignment with a second set of the mounting bosses. As with respect to the first set of mounting bosses, mounting bosses of the second set have fastener-receiving cavities accessible from their undersides, such that a second set of the fasteners extends through the holes in the lensing member to secure it to the lower surface of the heat-conductive overstructure.

The one-piece lensing member may be dimensioned to extend beyond edges of the circuit board. In such embodiments, the one-piece lensing member may include an edge portion engaging a gasket to provide a weathertight seal around the circuit board. The lensing member may be of a polymeric material, and compression-limiting inserts are in each of the holes of the lensing member.

In another aspect of this invention, an LED light fixture is of the type including a heat-conductive structure that has a plurality of upwardly-protruding elongate fins extending from distal fin-ends, typically at a fixture edge, to proximal fin-ends adjacent to vertical-flow openings through the fixture, the fins defining horizontal between-fin channels that are open at the distal fin-ends. The improvement in such fixture is the incorporation of a plurality of flow-interrupters between adjacent fins thereby changing air flow along the channels. Such flow-interrupters significantly improve heat dissipation in the inventive LED light fixtures.

As used herein in referring to portions of the devices of this invention, the terms "upward," "upwardly," "upper," "lower," "top," "bottom" and other like terms assume that the light fixture is in its position of use, recognizing, of course, that hot air rises.

In descriptions of this invention, including in the claims below, the terms "comprising," "including" and "having" (each in their various forms) and the term "with" are each to be understood as being open-ended, rather than limiting, terms.

BRIEF DESCRIPTION OF THE DRAWINGS

FIG. 14 is a plan view of a lower surface of a heat-conductive overstructure.

FIG. 15 is a plan view of an upper surface of a heat-conductive overstructure.

DETAILED DESCRIPTION OF CERTAIN EMBODIMENTS

Figure 1:
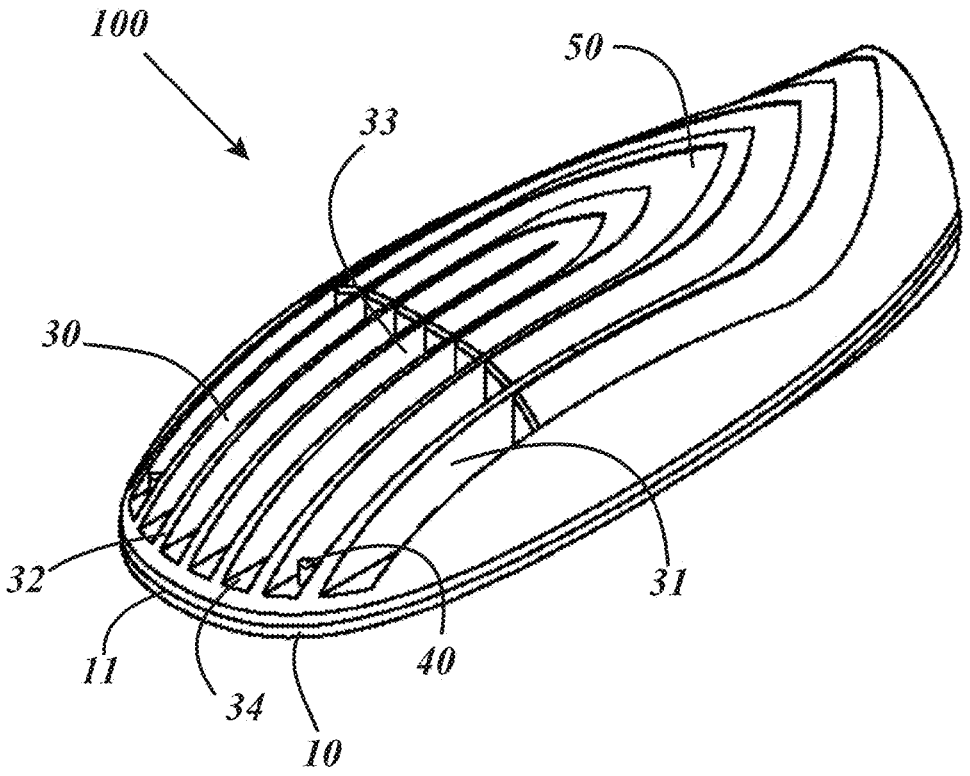
FIG. 1 is a top perspective view of an LED light fixture according to the present invention.
Figure 2:
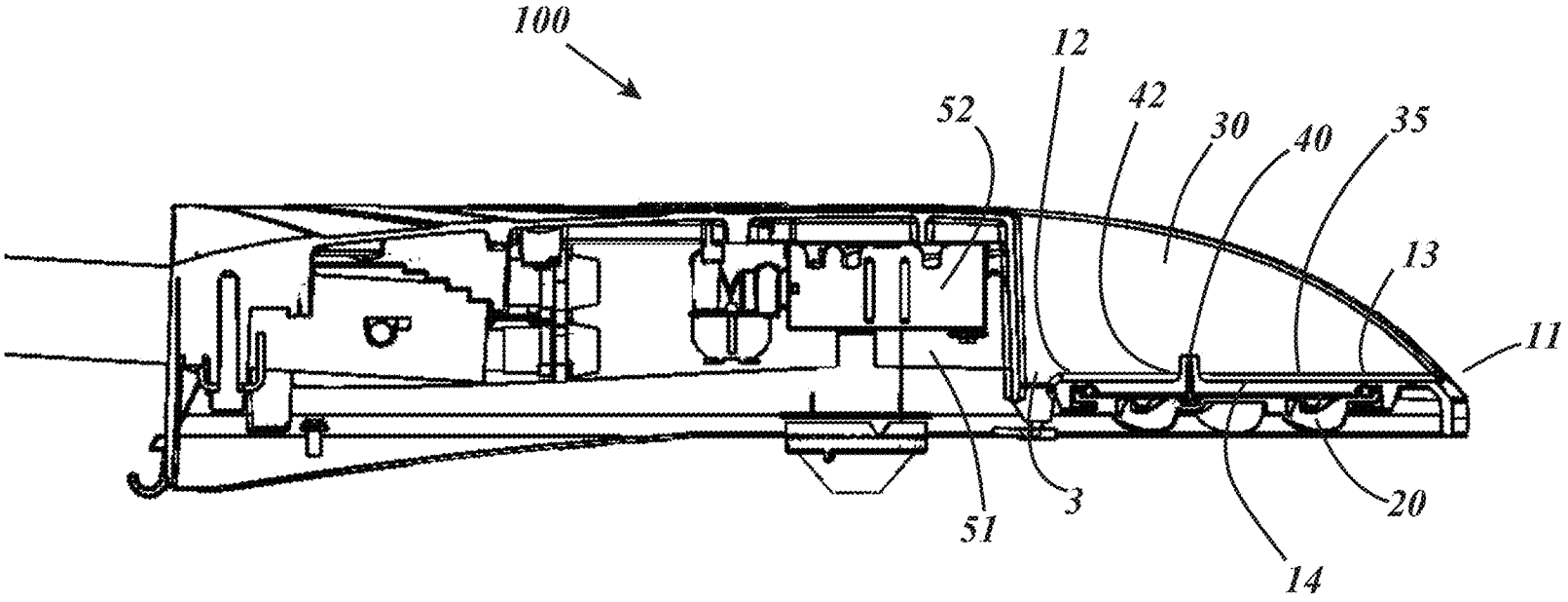
FIG. 2 is a lengthwise sectional view of the fixture of FIG. 1.

FIGS. 1-16 illustrate aspects of an LED light fixture 100 according to the present invention. Fixture 100 includes a heat-conductive overstructure 10, an LED light source 20 and a heat sink 30, as best seen in FIG. 2. Overstructure 10 has an upper surface 13 and a lower surface 14 and first and second ends 11 and 12.

Figure 16:
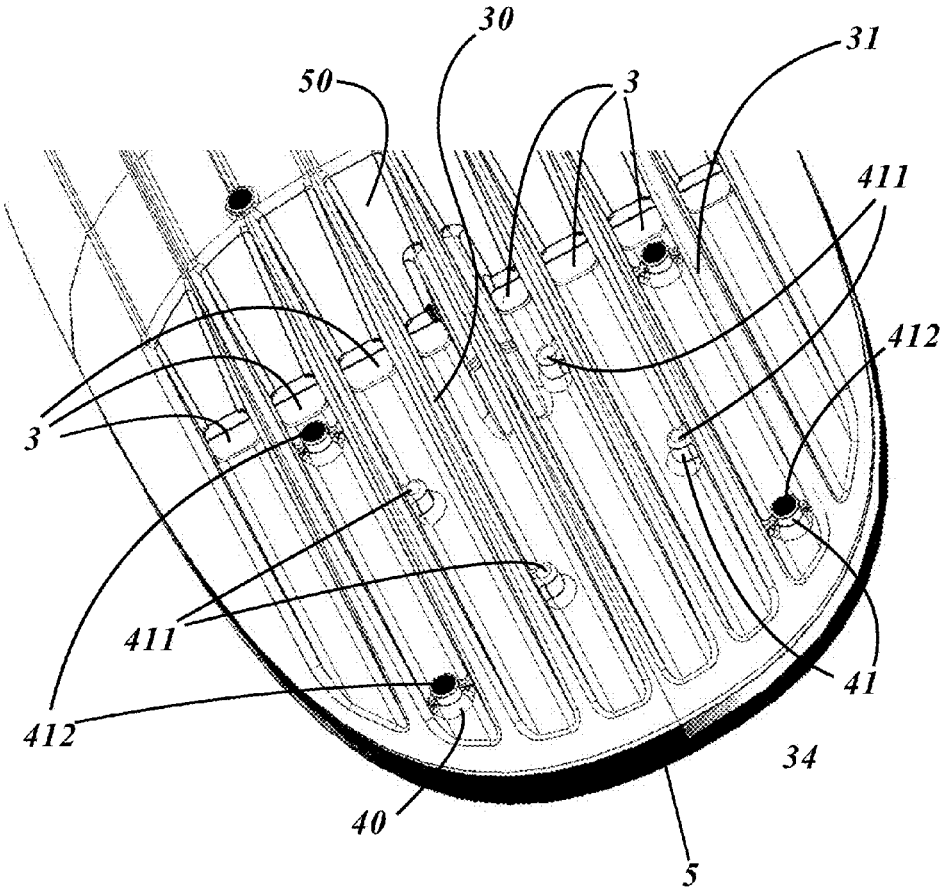
FIG. 16 is a fragmentary top perspective view of the LED light fixture of one embodiment of the present invention.

FIGS. 2, 5, 6, 12 and 13 show LED light source 20 secured with respect to lower surface 14. Heat sink 30 is on upper surface 13 and has a plurality of upwardly-protruding elongate fins 31 extending therealong from distal fin-ends 32 adjacent to first end 11 to proximal fin-ends 33 adjacent to second end 12, as best illustrated in FIGS. 15 and 16. Fins 31 define horizontal between-fin channels 34 open at distal fin-ends 32.

Fixture 100 further includes a plurality of flow-interrupters 40 each disposed between adjacent pair of fins 31 and changing air flow along channels 34. FIGS. 2, 3, 14 and 15 show that fixture 100 further defines vertical-flow openings 3 adjacent to proximal fin-ends 33.

Figure 5:
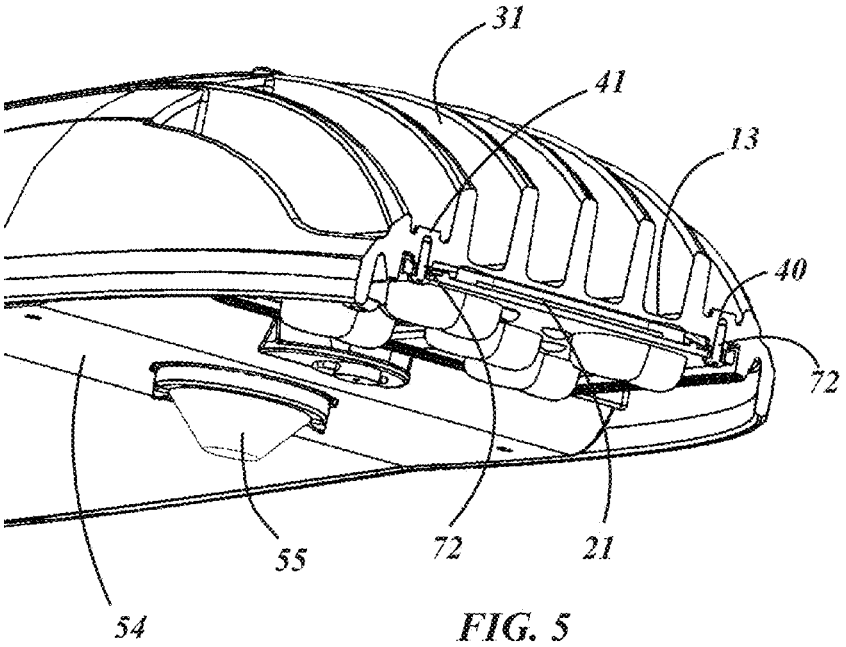
FIG. 5 is a sectional view across fixture of FIG. 1 and showing mounting bosses which secure a one-piece lensing member to the heat sink.
Figure 6:
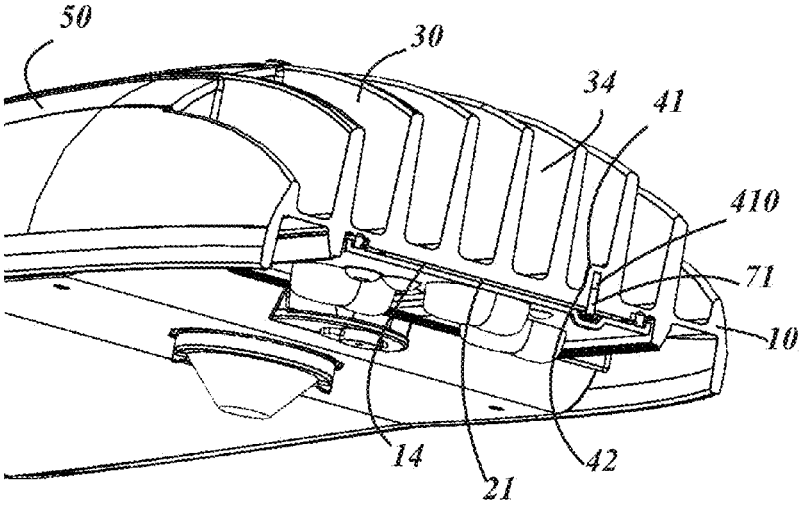
FIG. 6 is a sectional view across fixture of FIG. 1 and showing mounting bosses which secure a circuit board to the heat sink.
Figure 7:
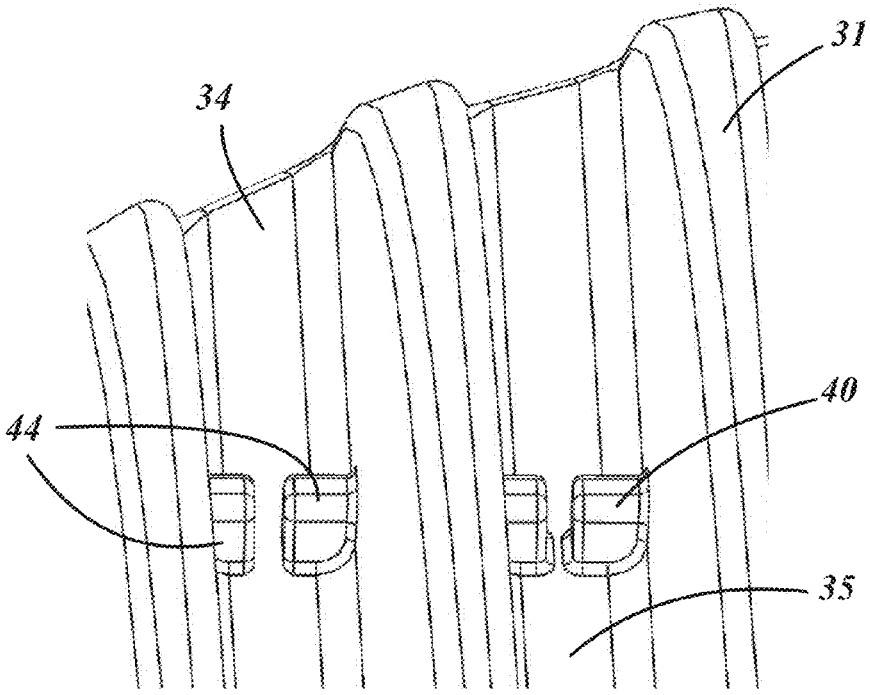
FIG. 7 is a fragmentary top perspective view showing flow-interrupters extending from each of adjacent fins for less than entire width of between-fin channel.
Figure 8:
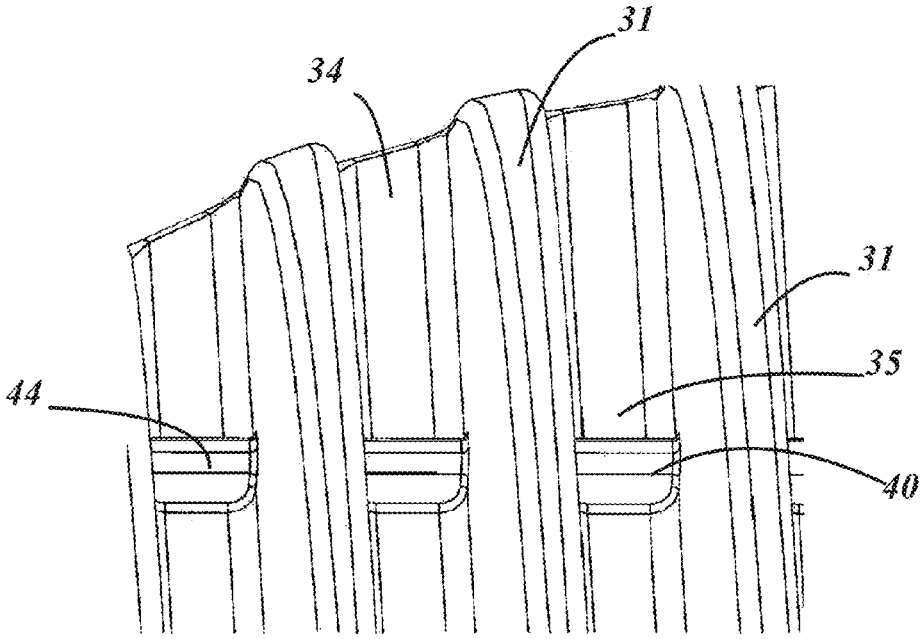
FIG. 8 is a fragmentary top perspective view showing flow-interrupters extending for the entire width of between-fin channel.
Figure 9:
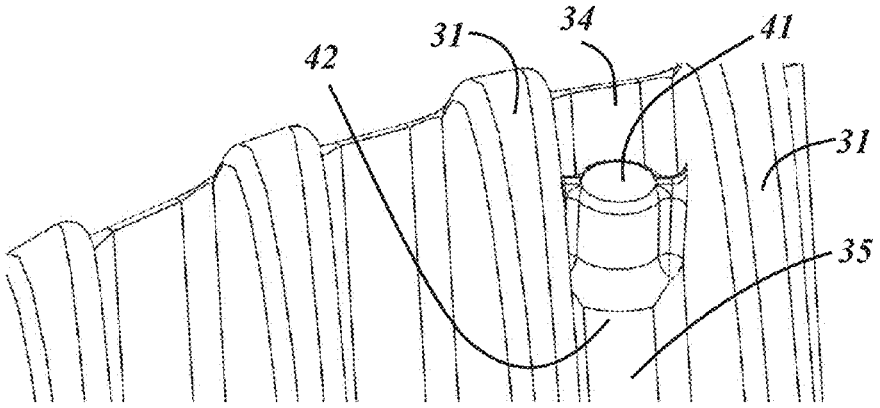
FIG. 9 is a fragmentary top perspective view showing flow-interrupters extending for the entire width of between-fin channel and including a mounting boss.
Figure 10:
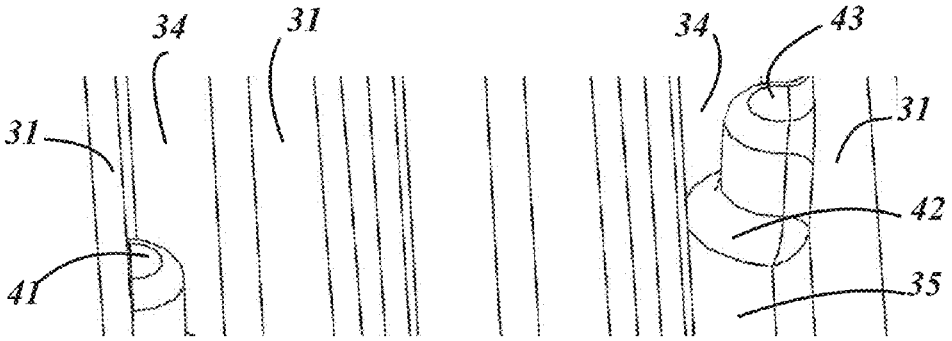
FIG. 10 is a fragmentary top perspective view showing a mounting boss alongside of one fin and forming a flow-interrupter extending for less than entire width of between-fin channel.
Figure 11:
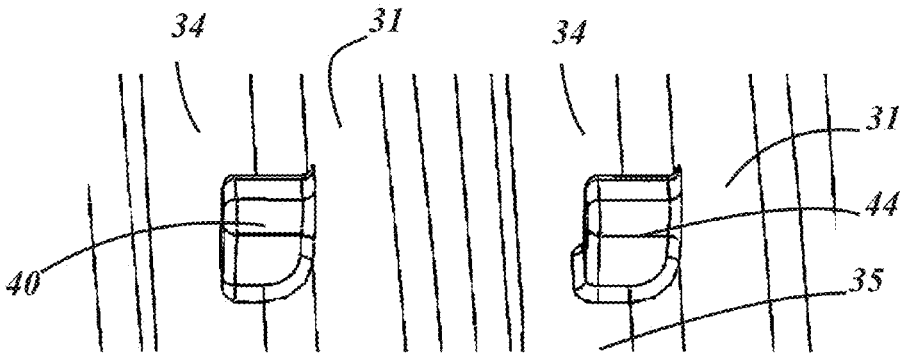
FIG. 11 is a fragmentary top perspective view showing flow-interrupters extending from one of adjacent fins for less than entire width of between-fin channel.

FIGS. 1, 2 and 5-11 show flow-interrupters 40 having heights which are less than the heights of their respective between-fin channels 34. FIGS. 5 and 6 illustrate flow-interrupters 40 with heights less than about half the heights of their respective between-fin channels 34. Channels 34 have channel bottom surfaces 35 and flow-interrupters 40 extend upwardly from surfaces 35, as best seen in FIGS. 7-11. FIGS. 8 and 9 show flow-interrupters 40 dimensioned to extend across the full widths of their respective channels 34. FIGS. 7, 10 and 11 show flow-interrupters 40 dimensioned to extend across less than the full widths of their respective channels 34, thereby allowing water flow past them along bottom surfaces 35. FIG. 10 and illustrate flow-interrupters 40 engaging only one of the two fins 31 that form their respective channels 34.

FIGS. 1, 2, 5, 6, 9 and 10 show flow-interrupters 40 being posts 41 (i.e., post-like structures) that extend upwardly from proximal post-ends 42 at bottom surfaces 35 of their respective channels 34 to free distal post-ends 43 somewhat above bottom surfaces 35 of their respective channels 34. FIGS. 9, 10, 14 and 15 best show that in such situations flow-interrupter posts 41 serve as connection points (mounting bosses) accepting fasteners 7, from beneath bottom surface 35, for securement of LED light source 20 to lower surface 14 of heat-conductive overstructure 10.

FIGS. 7, 8 and 11 illustrate flow-interrupters 40 as wall structures 44 that are integrally-formed with their respective channel bottoms 35 with and at least one of fins 31 forming their respective channels 34. In FIG. 11, wall structures 44 are integrally-formed with only one of fins 31 forming their respective channels 34. This allows water flow past wall structures 44 along bottom surfaces 35 of their respective channels 34.

FIGS. 1, 2, 5, 6 and 16 best show elongate fins 31 of heat sink 30 having heights which are smallest at distal fin-ends 32, which are shown as the location where elongate fins 31 reach an edge 5 of fixture 100, and gradually increase toward proximal fin-ends 33.

FIGS. 5 and 6 show overstructure 10 and heat sink 30, with all portions thereof (including fins 31 and flow-interrupters 40), formed as one piece.

Figure 12:
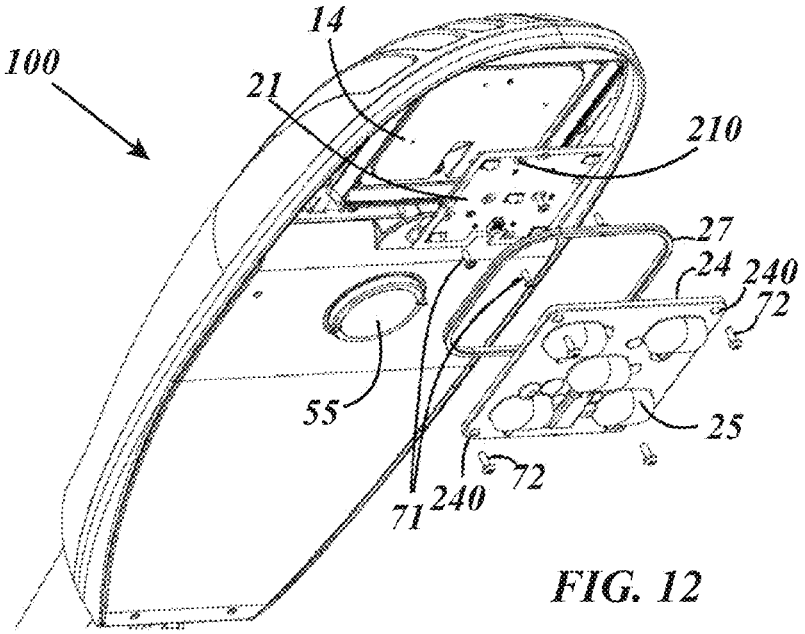
FIG. 12 is an exploded bottom perspective view of the light fixture of FIG. 1.
Figure 13:
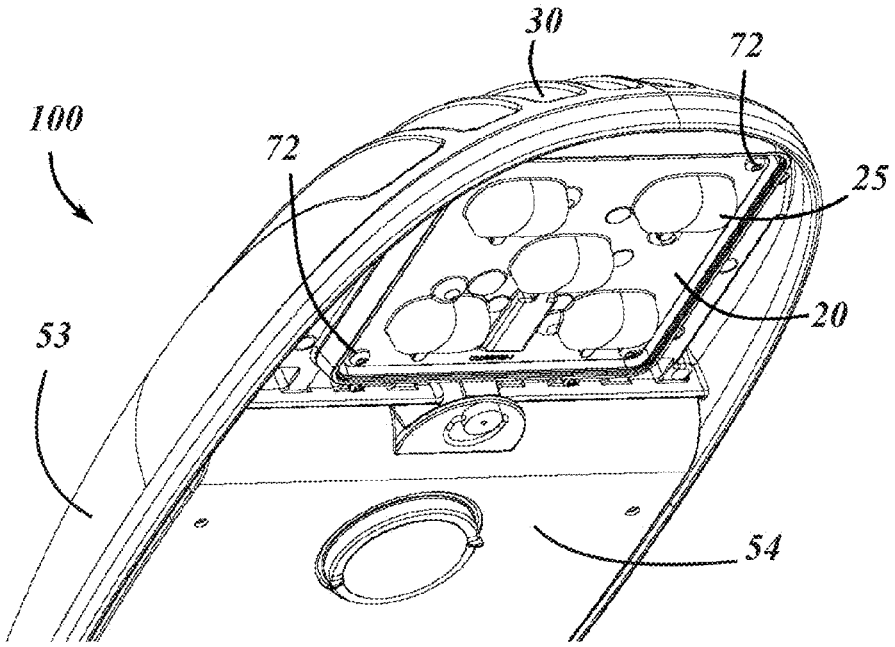
FIG. 13 is a bottom perspective view of the fixture of FIG. 1.

FIG. 2 further shows that LED light fixture 100 also includes a housing 50 secured with respect to overstructure 10. Housing 50 includes a substantially-closed chamber 51 that encloses at least one electronic LED driver 52. In FIG. 2, housing 50 is at second end 12 of overstructure 10. FIGS. 14 and 15 show the vertical-flow openings 3 as partially defined by housing 50, and proximal fin-ends 33 secured with respect to housing 50. FIG. 1 also shows housing 50 and heat sink 30 formed as one piece. FIGS. 12 and 13 also show overstructure 10, heat sink 30 and a major top part 53 of housing 50 all formed as one piece which is a single casting. Housing 50 also includes a minor bottom part 54 which is a separate piece removable for access into chamber 51. A sensor 55 may be secured with respect to housing 50.

Figure 3:
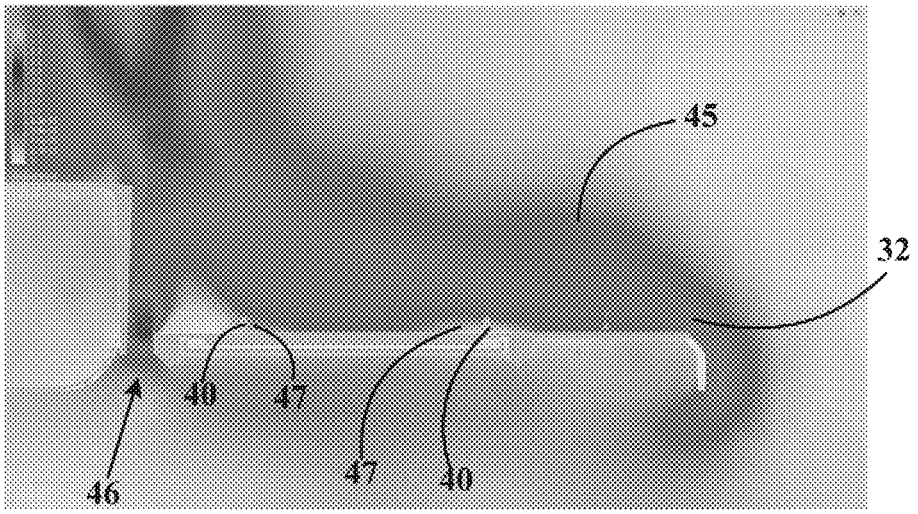
FIG. 3 is a simulated flow diagram illustrating heat dissipation from the light fixture of FIG. 1.
Figure 4:
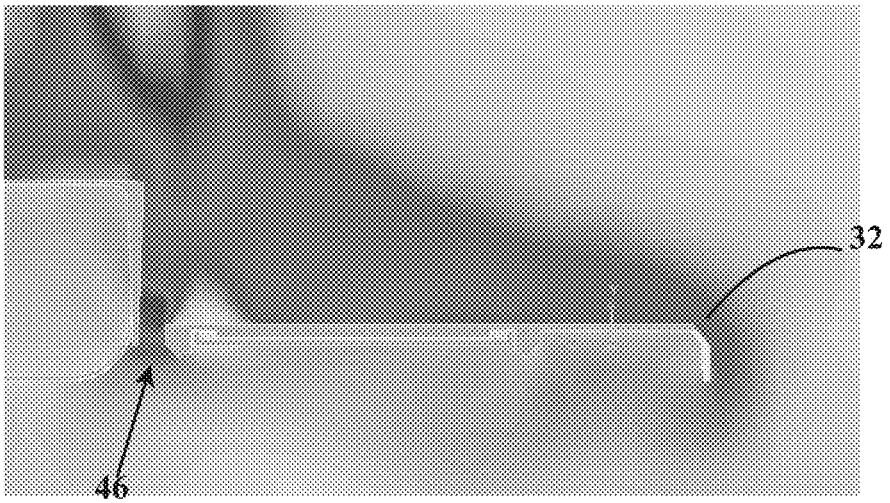
FIG. 4 is a simulated flow diagram illustrating heat dissipation from the prior light fixture similar in structure to the fixture of FIG. 1, but lacking flow-interrupters in the cooling portion of the fixture.

FIGS. 3 and 4 illustrate how flow-interrupters 40 give appreciably improved heat-dissipation performance, possibly because of enhanced turbulence 45 in the between-fin air flow. Such turbulence 45 is in the air flow between adjacent pairs of fins 31 from the entry point at distal fin-ends 32 to the point of upward air flow 46 through and immediately above vertical-flow openings 3 in fixture 100. It is believed that air flow at the entry point of the channels may generally be laminar, and that when it reaches flow-interrupters 40 the flow becomes turbulent, thereby enhancing the heat transfer of regions 47 of the heat sink on the downstream side of flow-interrupters 40.

Figure 17:
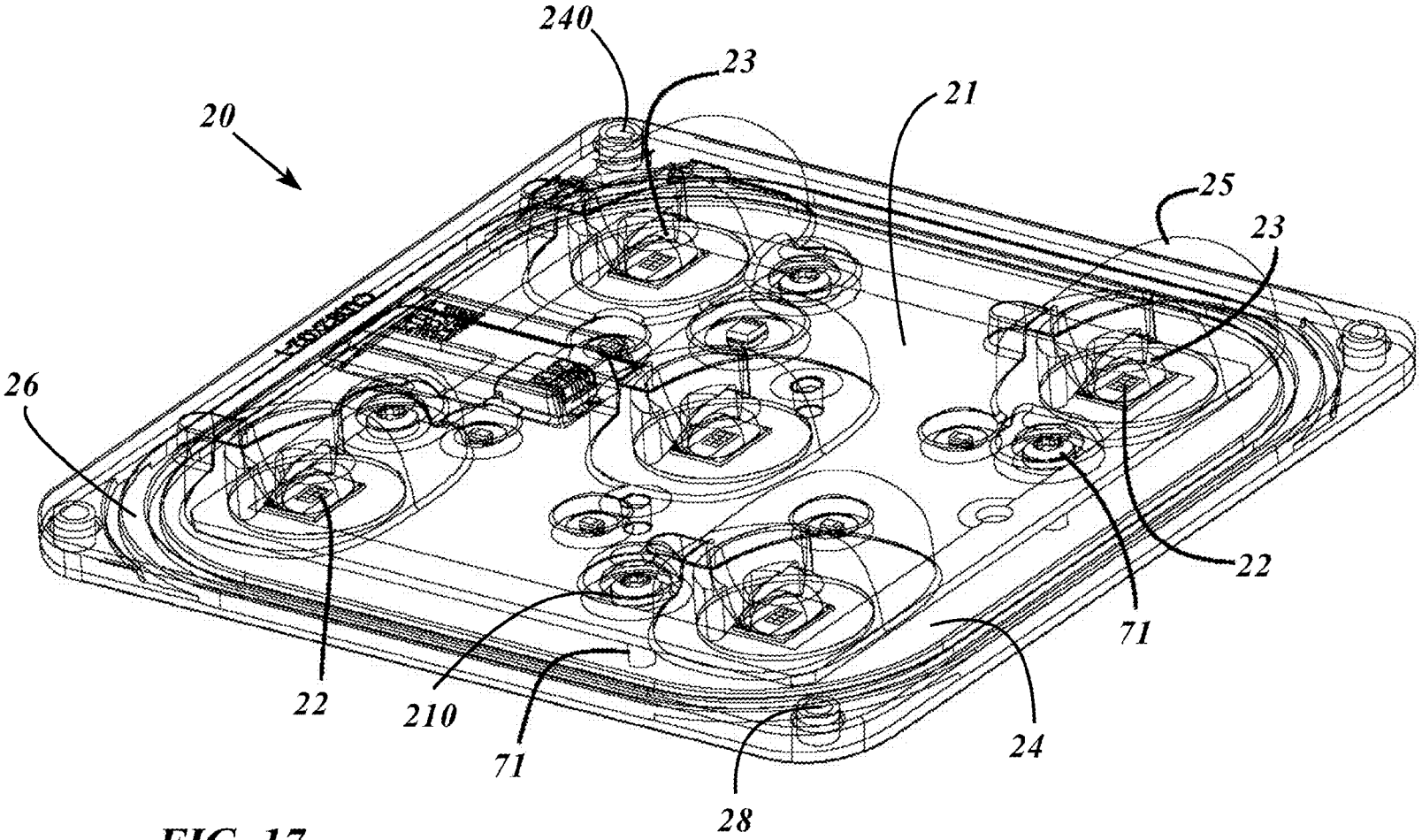
FIG. 17 is a perspective view of an LED light source.

FIGS. 12 and 17 illustrate LED light source 20 as including a circuit board 21 with a plurality of LED emitters 22 spaced thereon and a plurality of primary lenses 23 each over a corresponding one of LED emitters 22. Circuit board 21 defines holes 210 therethrough in positions for alignment with a first set of mounting bosses 411. As best seen in FIGS. 2, 5, 6 and 14, mounting bosses 411 have fastener-receiving cavities 410 accessible from their undersides. FIGS. 2, 6 and 17 show a first set of fasteners 71 extending through holes 210 in circuit board 21 and into mounting bosses 41 to secure circuit board 21 to lower surface 14 of heat-conductive overstructure 10.

FIGS. 12 and 17 further best show that LED light source 20 also includes a one-piece lensing member 24 placed over circuit board 21 and, as best seen in FIGS. 5 and 6, against lower surface 14 of heat-conductive overstructure 10 with circuit board 21 sandwiched therebetween. FIG. 17 best shows that lensing member 24 includes a plurality of secondary lenses 25 each spaced over a corresponding one of primary lenses 23. Lensing member 24 defines holes 240 therethrough in positions for alignment with a second set of mounting bosses 412 which have fastener-receiving cavities 410 accessible from their undersides, such that a second set of the fasteners 72 extends through holes 240 in lensing member 24 to secure it to lower surface 14 of heat-conductive overstructure 10.

FIGS. 5, 6, 12 and 17 best show that one-piece lensing member 24 is dimensioned to extend beyond edges of circuit board 21. One-piece lensing member 24 includes an edge portion 26 engaging a gasket 27 to provide a weathertight seal around circuit board 21. Since lensing member 24 may be made of a polymeric material, compression-limiting inserts 28 may be used in each of holes 240 of lensing member 24.

While the principles of the invention have been shown and described in connection with specific embodiments, it is to be understood that such embodiments are by way of example and are not limiting.

The invention claimed is:

1. An LED light fixture comprising:

a heat-conductive overstructure having upper and lower surfaces and a plurality of upwardly-protruding elongate fins extending along the upper surface;

an LED light source secured with respect to the lower surface; and the fixture defining at least one opening through the fixture permitting air flow from beneath the lower surface to above the upper surface, each one of the elongate fins having a height which gradually increases toward a respective end of the fin closest to the at least one opening.

2. The LED light fixture of claim 1 further comprising a housing secured with respect to the overstructure, the housing including a substantially-closed chamber enclosing at least one electronic LED driver.

3. The LED light fixture of claim 2 wherein the housing is at the overstructure fin-ends proximal to the at least one opening.

4. The LED light fixture of claim 3 wherein:

the overstructure fin-ends proximal to the at least one opening are secured with respect to the housing; and the at least one opening is partially defined by the housing.

5. The LED light fixture of claim 4 wherein the overstructure and the housing are formed as one piece.

6. The LED light fixture of claim 5 wherein the one piece of the overstructure and the housing is a casting.

7. The LED light fixture of claim 1 wherein the LED light source includes a circuit board with a plurality of LED emitters spaced thereon and a plurality of primary lenses each over a corresponding one of the LED emitters, the circuit board defining holes in positions aligned with a first set of mounting bosses and receiving a first set of the fasteners therethrough.

8. The LED light fixture of claim 7 wherein the LED light source includes a one-piece lensing member over the circuit board, the lensing member including a plurality of secondary lenses each spaced over a corresponding one of the primary lenses, the lensing member defining holes in positions aligned with a second set of mounting bosses and receiving a second set of the fasteners therethrough.

9. The LED light fixture of claim 8 wherein the one-piece lensing member is dimensioned to extend beyond edges of the circuit board, the one-piece lensing member including an edge portion engaging a gasket providing a weathertight seal around the circuit board.

10. The LED light fixture of claim 9 wherein:

the one-piece lensing member is of a polymeric material; and compression-limiting inserts are in each of the holes of the lensing member.

11. An LED light fixture comprising:

a heat-conductive structure that includes a plurality of upwardly-protruding elongate fins, each one of the elongate fins having a height which gradually increases toward a respective fin-end closest to at least one opening formed through the fixture to permit upward flow of air through the fixture; and a housing secured with respect to the heat-conductive structure, the housing including a substantially-closed chamber enclosing at least one electronic LED driver, the at least one opening through the fixture being partially defined by the housing.

12. An LED light fixture comprising a heat-conductive structure that includes a plurality of upwardly-protruding elongate fins, each one of the elongate fins having a height which gradually increases toward a respective fin-end closest to at least one opening formed through the fixture to permit upward flow of air through the fixture.

13. The LED light fixture of claim 12 wherein the fins define horizontal between-fin channels open at the distal fin-ends such that during operation air is drawn into the horizontal channels at the distal fin-ends and is drawn therealong by upward air-flow through the openings at the proximal fin-ends.

14. A light fixture comprising elongate fins protruding from a heat-conductive structure in a first direction and defining between-fin channels extending in a direction transverse the first direction, each of the elongate fins having a height which gradually increases toward a respective end of the fin closest to at least one opening through the fixture permitting air flow through the fixture such that during operation air is drawn through the at least one opening.

15. The light fixture of claim 14 wherein the at least one upward-flow opening includes between-fin upward-flow openings.

16. The light fixture of claim 15 wherein the upward-flow openings are vertical-flow openings.

17. The LED light fixture of claim 14 further comprising a housing secured with respect to the heat-conductive structure, the housing including a substantially-closed chamber enclosing at least one electronic LED driver.

18. The LED light fixture of claim 17 wherein the housing is disposed adjacent to the at least one opening through the fixture.

* * * * *